United States Patent [19]

Papke et al.

[11] Patent Number: 4,995,993

[45] Date of Patent: Feb. 26, 1991

[54] PROCESS FOR PREPARING OVERBASED METAL SULFONATES

[75] Inventors: Brian L. Papke, Wappingers Falls; Leonard S. Bartley, Jr., Newburgh, both of N.Y.

[73] Assignee: Texaco Inc., White Plains, N.Y.

[21] Appl. No.: 452,140

[22] Filed: Dec. 18, 1989

[51] Int. Cl.[5] ..... C10M 135/10

[52] U.S. Cl. ..... 252/25; 252/18; 252/33; 252/33.4

[58] Field of Search ..... 252/39, 38, 18, 25, 252/33

[56] References Cited

U.S. PATENT DOCUMENTS

| | | | |
|---|---|---|---|
| 3,830,739 | 8/1974 | Kemp | 252/33.4 |
| 4,387,033 | 6/1983 | Lenack | 252/18 |
| 4,541,938 | 9/1985 | Jack | 252/33 |
| 4,604,219 | 8/1986 | Whittle | 252/33 |
| 4,780,224 | 10/1988 | Jao | 252/33 |
| 4,810,396 | 3/1989 | Jao | 252/33 |
| 4,822,502 | 4/1989 | Muir | 252/33.4 |

FOREIGN PATENT DOCUMENTS

| | | | |
|---|---|---|---|
| 0822705 | 9/1969 | Canada | 252/33 |

*Primary Examiner*—Jacqueline V. Howard

*Attorney, Agent, or Firm*—Robert A. Kulason; James J. O'Loughlin; Vincent A. Mallare

[57] ABSTRACT

A method of preparing a amorphous metal sulfonate detergent for lubricants. The sulfonate detergent is prepared by:

(a) mixing, stirring and heating a diluted metal sulfonate with $Ca(OH)_2$;

(b) adding to the stirred, heated sulfonate mixture a sufficient amount of $CO_2$ to heat with all the $Ca(OH)_2$ added;

(c) adding a zeolite to the mixture partway through the addition of $CO_2$ to remove a certain percentage of the total water in said mixture;

(d) filtering the water-removed mixture to separate an amorphous metal sulfonate product; and (e) recovering the amorphous overbased metal sulfonate product.

6 Claims, No Drawings

PROCESS FOR PREPARING OVERBASED METAL SULFONATES

BACKGROUND OF THE INVENTION

This invention relates to overbased metal sulfonates, and more particularly, to an improved process for preparing overbased alkaline earth metal sulfonates in which the formation of crystalline metal carbonates is eliminated.

Calcium sulfonate additives are generally produced by carbonating a hydrocarbon solution of a "neutral" calcium sulfonate, a calcium base (usually calcium hydroxide and/or calcium oxide), and various reaction promoters which include low molecular weight alcohols (usually methanol), water, ammonium carboxylates (usually ammonium formate), and calcium chloride. During the reaction the calcium base reacts with gaseous carbon dioxide to form calcium carbonate. The calcium carbonate is incorporated into small inverted micellar structures during this process; these basic calcium sulfonate micelles effectively render the calcium base oil soluble, a necessary step for this product to be useful in a lubricating oil. The final product must be filtered or centrifuged to remove unreacted solids, particularly since an excess of the calcium base is used in the production of highly basic sulfonates [in the 300–500 Total Base Number (TBN) range]. In this process, the amount of gaseous carbon dioxide charged to the system is critical in order to prevent a phenomenon termed "overcarbonation". If the $CO_2$ charge exceeds 80–95% of that theoretically required to react with the calcium base, the calcium carbonate incorporated into the product begins to crystallize, resulting in unacceptable products. Generally an "overcarbonated" product will filter extremely slowly and will have a low TBN value. In addition, "overcarbonated" products are often unacceptably hazy, due to the presence of large micellar structures containing crystalline calcium carbonate. Although the onset of complete crystallization is usually very rapid, small amounts of crystalline carbonate may form earlier in the reaction, presumable due to small inhomogeneities in large scale reactor mixing. Partially crystalline products are also undesirable, even if they are not hazy, since they are known to have poor stability characteristics in blends with other common lubricant additives.

Thus, an object of the present invention is to provide an improved process to prepare overbased alkaline earth and other metal detergents having superior stability and resistance to the formation of crystalline calcium carbonate; this process also results in a reduction in solids waste and improved feedstock utilization.

DISCLOSURE STATEMENT

U.S. Pat. Nos. 4,810,396; 4,780,224; 4,604,219; 4,541,938; 4,387,033; and 3,830,739 all disclose Various processes for producing overbased metal sulfonates detergent additives. Although a variety of processes are described, including the addition of water and other promoters as well as different feedstock sources, all these processes require that the amount of carbon dioxide charged to the reaction be carefully monitored and controlled in order to obtain satisfactory products. Specifically, the amount of $CO_2$ charged to the reaction is optionally 75 to 85% of the total amount theoretically required to react with the base charged to the system. If less $CO_2$ is charged, the products have low TBN values, if excessive amounts of $CO_2$ are charged, problems associated with overcarbonation are encountered.

C. Belle et. al., in their article "Recent Progress in Overbasin Detergent Additives for Lubrication" [Comm. Jorn. Com. Esp. Deterg., 19 pp 465–474 (1988)], disclose that the amount of $CO_2$ charged to an overbasing reaction is critical. If excessive amounts of $CO_2$ are charged, overcarbonation is observed; i.e., the product TBN decreases rapidly and carbonate crystallization occurs.

J. F. Marsh, in his article "Colloidal Lubricant Additives", [Chem. Indust., 20 pp 470–473 (1987)], discloses an overbasing process that produces calcium carbonate colloids which consist of amorphous carbonate containing between 5 to 10% hydroxide. In this process, the carbonation must be stopped before the stoichometric amount of carbon dioxide has been charged. Carbonation beyond this point results in the formation of a hazy crystalline product containing sulfonates of an undesirable large particle size.

C. R. Dawson, et. al., in their article "Manufacture of a Highly Basic Engine Oil Detergent Additive" [ACS Div. Pet. Chem. Pet. Reprints, pp 45–50 (1959)], also disclose that simple reaction of stoichiometric amounts of lime and $CO_2$ does not yield the desired product. An excess lime charge (roughly equivalent to a reduced $CO_2$ charge) is required to prevent the formation of a hazy crystalline) product containing unacceptably large particle (micelle) sizes. In their process, carbonate crystallization resulted in products which formed unfilterable gels.

All of the overbasing processes disclosed here suffer from the disadvantages that the $CO_2$ charge must be critically controlled, and excess lime must be charged to the reaction. Excessive $CO_2$ addition always results in undesirable products and serious processing difficulties.

SUMMARY OF THE INVENTION

The present invention provides a method for preparing a highly overbased alkaline earth metal sulfonates by a novel process which eliminates the formation of crystalline metal carbonates in the final product. Furthermore, the amount of gaseous carbon dioxide charged to the system is not critical in this invention; an excess of carbon dioxide over 100% of that required in theory may be added, resulting in a higher TBN product, improved sulfonate and lime utilization, and reduced solids waste. The final product contains no crystalline carbonate, and yet is very fluid and has high filtration rates, in contrast to typical "overcarbonated" overbased sulfonates prepared using the prior art.

The present invention also avoids certain processing difficulties which precede carbonate crystallization referred to herein as "precrystallization" phenomenon.

Specifically, the present invention provides a method of preparing an amorphous overbased calcium sulfonate detergent for lubricants, said method comprising;

(a) mixing a solution of a calcium sulfonate in a volatile hydrocarbon solvent with $CH_3OH$ and $Ca(OH)_2$ solids;

(b) stirring and heating said sulfonate mixture;

(c) adding to said stirred sulfonate mixture a sufficient amount of $CO_2$ to react with up to 80% of the $Ca(OH)_2$;

(d) adding an activated solid adsorbent to said $CO_2$ treated mixture to remove at least 35% of the water generated in the entire carbonation reaction;

(e) continuing addition of $CO_2$ until the total amount of $CO_2$ added exceeds 90–105% of the amount required to react with the $Ca(OH)_2$ solids;

(f) filtering said adsorbent-treated sulfonate mixture to separate the adsorbent and any unreacted $Ca(OH)_2$ solids from an amorphous calcium sulfonate product;

(g) stripping said sulfonate product of said volatile hydrocarbon solvent; and (h) recovering the amorphous overbased calcium sulfonate product".

DETAILED DESCRIPTION OF THE INVENTION

The present invention provides a method to prevent carbonate crystallization from occurring during the preparation of highly overbased sulfonate detergent additives in the 300–500 TBN range. The significant factor of this invention is the selective removal of water from the reaction system prior to the completion of the carbon dioxide addition, either through physical adsorption or chemical reaction. Water is normally present in the overbasing reaction medium. It may be added initially as a reaction promoter (as described in U.S. Pat. Nos. 4,810,396; 4,780,224; 4,387,033; and U.K. Pat. No. 2,058,118), or during the course of the overbasing reaction (as described in U.S. Pat. Nos. 4,780,224, 4,387,033 and 4,604,219). In addition, water will be generated in increasing amounts during the present reaction if calcium hydroxide is present:

$$Ca(OH)2 + CO_2 \rightarrow CaCO_2 + H_2O$$

While the addition of water has certain benefits when added at the beginning of the overbasing reaction, it is the chief cause of metal carbonate crystallization as the $CO_2$ charge approaches 100% of theoretical. The resulting crystalline product is usually termed "overcarbonated", a term indicative of the undesirable characteristics of this product. The accepted method for avoiding overcarbonated or partly crystalline products is to carefully control the gaseous carbon dioxide charge so as to not exceed 90% of the theoretical amount necessary to fully react with the base charged to the system. Typically the $CO_2$ charge is controlled within the 75–85% range.

In the present invention, water is removed during the overbasing reaction prior to the completion of $CO_2$ addition by contacting the overbasing reaction mixture or the reflux liquids with a suitable adsorbent material, preferably a material that selectively adsorbs the water but not the lower alkanol (methanol). A suitable drying agent will remove water from the reaction by either a chemical reaction (involving the formation of new compounds or hydrates) or by physical adsorption. Since solids waste volume is a critical factor to consider in the production of overbased sulfonates, the preferred drying agent is one that can be regenerated. Examples of regenerative drying agents that are normally added in a batchwise process include calcium chloride and calcium sulfate. These materials effectively remove water through the formation of hydrates. However, these materials would have to be removed from the reaction mixture by filtration or decantation, processes that are complicated by unreacted solids present in overbasing reaction mixtures. An alternative drying method is to use a solid adsorbent which could be used in a large packed bed or column. One particularly attractive method would be to incorporate the solid adsorbent into a reflux condenser, so that only solvent vapors (and no calcium solids) would come into contact with the adsorbent. Such a procedure would enhance adsorbent regeneration by preventing reaction solids from fouling the adsorbent. Examples of solid adsorbents include activated alumina, silica gel, and molecular sieves.

Molecular sieves (also known as zeolites) are particularly attractive for a number of reasons. Zeolites are crystalline framework aluminosilicates containing alkali metal cations; commercial materials are usually synthetic. Their structure is a network of $AlO_4$ and $SiO_4$ tetrahedra linked to each other by shared oxygen atoms. The ordered crystalline structure of the molecular sieve provides pores of a constant size, with openings that can admit molecules of a particular size while excluding larger molecules (hence the term molecular sieve). Molecular sieve materials are available which will readily adsorb water while excluding methanol and carbon dioxide. This is important since the methanol is a reaction promoter, and its elimination prior to the completion of the carbonation reaction would be detrimental. Zeolites have an advantage over alumina and silica gel because their desiccating properties are still good at elevated temperatures. Both alumina and silica gel experience a rapid loss in desiccating ability above 40° C., and overbasing reactions are often run at the reflux temperature of the hydrocarbon/methanol mixture (usually around 50°–70° C.). Molecular sieves are inert to most fluids and are physically stable even when wetted with water.

Crystallization of carbonate incorporated within the sulfonate micellar core is greatly reduced or eliminated by removal of a certain critical amount of water in the course of the overbasing reaction. Experimentally, it has been determined that for a process utilizing 100% calcium hydroxide as the feedstock, it is necessary to remove at least 40–45% of the total water before carbonate crystallization is avoided. Overbased sulfonate products containing crystalline calcium carbonate are always undesirable, for reasons discussed earlier, and crystallization must be avoided at all costs. The subject invention offers the distinct advantage in that a crystalline product is not produced even when the carbon dioxide charge exceeds 100% of theory. However, product improvements are not limited to an avoidance of crystallinity, as important as that may be. The subject invention also avoids what may be called "pre-crystallization" phenomenon.

To understand the term "pre-crystallization phenomenon", one must consider in more detail the events preceding the onset of crystallization. It is known through light scattering and transmission electron microscopy studies that crystalline core overbased calcium sulfonates have large micellar diameters, in the 400–600 Angstrom range. In contrast, the preferred product contains an amorphous calcium carbonate core and has a diameter of 100–150 Angstroms (for nominal 400 TBN products). Since it can be shown through ultracentrifugation separations that the crystalline core sulfonates always have large micellar sizes, a massive agglomeration process must occur prior to crystallization of the carbonate core. For example, if it is assumed that the 100% amorphous-core sulfonate has an inorganic core diameter of 100 Angstroms, and the crystalline-core sulfonate a diameter of 400 Angstroms, then at least 64 amorphous-core sulfonates must agglomerate to form a single crystalline-core sulfonate. That number increases rapidly with size; a 600 Angstrom crystalline-core sulfonate requires the agglomeration of over 216 amorphous micelles. If crystallization occurred first, and then resulted in particle agglomeration, it would be expected that small crystalline-core sulfonate micelles would be present in partly crystalline samples. However, crystalline-core sulfonates are always found to have large micellar sizes. In other words, crystallization is the result of an agglomeration process, not the other way around. Certain events must occur during the overbasing process prior to crystallization resulting in the destabilization of the sulfonate micellar aggregates. These events may be termed the "pre-crystallization" phenomenon.

Since "pre-crystallization" phenomena involve a destabilization of the sulfonate micellar structure, such events will also affect product filterability, sulfonate utilization, final product size distributions, and ultimately product performance. The prior art limits carbon dioxide charge ratios to well below 100% (i.e. 75–85% of theoretical) not only to avoid crystallization, but to also avoid processing problems associated with "pre-crystallization" phenomenon. Since the subject process prevents crystallization, it also avoids or at least greatly reduces the micellar destabilizing events preceding crystallization. It is speculated that addition of a drying agent removes not only water which may be present in a water/methanol phase, but may also remove or at least prevent the incorporation of additional water into the polar sulfonate micellar core structures. It is believed that excess solvents (methanol and particularly water) incorporated into the polar sulfonate micellar core are responsible for the destabilization of the sulfonate micelles which occurs prior to crystallization.

According to the present invention and illustrated in the following Examples, the method of preparing a metal sulfonate may utilize a total amount of $CO_2$ that exceeds 90–105% of the amount required to react with the $Ca(OH)_2$ solids in the treated sulfonate mixture.

In the method, the sulfonate mixture is stirred at a rate sufficient to maintain the solids in suspension at a temperature of about 45° C. to about 60° C. The mixture may be stirred at a rate of about 600 to about 670 RPM.

The metal sulfonate product produced may have a total base number of about 300 to about 500 TBN.

The advantages and the significance of the present invention will be more apparent by considering the following Examples:

EXAMPLE 1

(This example illustrates the method of the present invention and the product improvements achieved through partial removal of water generated during the carbonation reaction).

Calcium sulfonate (224 g containing 44 wt % active material) was diluted with heptane (637 g) and methanol (55.3 g) in a 2 liter Morton-type glass reaction vessel. A 100–500 SUS (@ 40° C.) diluent oil (70 g) was added at this point, although the oil could also be added to the final product before solvent stripping. Calcium hydroxide (171.7 g) was added to the diluted mixture, which was then stirred at 655 RPM (5.72 ft/sec tip speed) using a 2 inch diameter flat blade disk turbine. Precise and reproducible mixing speeds were obtained using a G. K. Heller Series H motor controller. The mixture was heated to 50° C. for 30 minutes, then heated to 60° C. and gaseous carbon dioxide was introduced at a rate of 280 cc/minute for a time sufficient to charge the amount shown below in Table I. The $CO_2$ flow rate was controlled by a Brooks model 5850 E mass flow controller (with a Brooks model 5896 power/electronic supply); total $CO_2$ charge was measured using a Kessler-Ellis Intellect Integrating Totalizer. Activated molecular sieve zeolite (140g, 3A, 1/16 inch beads) was added after 2.0 hrs $CO_2$ addition (corresponding to 65% of the theoretical maximum $CO_2$ charge). The complete conversion of the $Ca(OH)_2$ charge to $CaCO_2$ will generate 4.8 g of water, requiring the addition of 209 g of zeolite (assuming an equilibrium adsorption capacity of 20 wt %); 140g of zeolite is sufficient to remove 67% of the total water generated. After complete $CO_2$ addition, the reaction mixture was allowed to cool to 50° C. and was stirred for an additional 30 minutes. The solids content of the crude reaction mixture was determined after centrifugation at 700 g for 10 minutes. Filtration rates were determined by measuring the total time for 200 cc of the crude product plus 50 cc of heptane wash through a Buchner funnel containing a 7 cc Whatman #4 filtration paper and 10.0 g of diatomaceous earth (½ atmosphere vacuum). Crystallinity was measured by infrared spectroscopy amorphous calcium carbonate has a broad infrared band absorption centered at ca. 865 $cm^{-1}$; crystalline calcium carbonate (vaterite or calcite) has a sharp infrared absorption centered at ca. 879 $cm^{-1}$. A comparison of overbased sulfonates with and without added zeolite, is shown below in Table I.

TABLE I

Overbased Calcium Sulfonate Comparisons: Advantages of Zeolite Addition

| | RUN | | | |
|---|---|---|---|---|
| | A | B | C | D |
| Wt. percent CO2 of stoichiometric | 78 | 105 | 104 | 116 |
| Percent water removed (3A zeolite) | 0 | 0 | 67 | 67 |
| Product Crystallinity | amor. | amor. | amor. | amor. |
| Sulfonate utilization (%) | 78 | 57 | 92 | 87 |
| Solids volume (%) | 22.4 | 32.7 | 17.4 | 17 |
| Total Base Number (TBN) | 402 | 325 | 430 | 430 |
| Kin Vis 100 C (cSt.) | — | — | 101 | 106 |
| Carbonate/Sulfonate Ratio (IR) | .966 | 933 | 1.16 | 1.25 |
| Filtration time (seconds) | 304 | >10,000 | 780 | 1116 |

When $CO_2$ charge amounts approach or exceed 100% of theoretical for the 100% calcium hydroxide process, the amorphous calcium carbonate begins to crystallize to form calcite; calcite is no longer retained within the sulfonate micelles, and precipitates. The remaining product may still be amorphous, as was the case in Run B, however, solids volumes are excessively high, TBN and % sulfonate utilization values are very low, and the crude product cannot be filtered. The present invention, Run C, results in an amorphous product which has a higher sulfonate utilization, lower solids volume and a higher TBN than the current art. This product also contains a greater percentage of carbonated base, as may be noted from the carbonate/sulfonate ratio, which may lead to improved engine performance. Run D demonstrates that large excesses of $CO_2$ may be charged to the reaction without encountering overcarbonation problems (crystallization, poor filtration, loss of TBN etc.).

EXAMPLE 2

(This example demonstrates that the amount of water removed is critical; if insufficient water is removed no improvements are noted. Excessive water removal does not result in additional product improvements).

Calcium sulfonate (224 g containing 44 wt % active material) was diluted with heptane (637 g) and methanol (55.3 g) in a 2 liter Morton-type glass reaction vessel. A 100–500 SUS (@ 40° C.) diluent oil (70 g) was added at this point, although the oil could also be added to the final product before solvent stripping. Calcium hydroxide (171.7 g) was added to the diluted mixture, which was then stirred at 655 RPM (5.72 ft/sec tip speed) using a 2 inch diameter flat blade disk turbine. Precise and reproducible mixing speeds were obtained using a G. K. Heller Series H motor controller. The mixture was heated to 50° C. for 30 minutes, then heated to 60° C. and gaseous carbon dioxide was introduced at a rate of 280 cc/minute for a time sufficient to charge the amount shown in Table II. The $CO_2$ flow rate was controlled by a Brooks model 5850 E mass flow controller (with a Brooks model 5896 power/electronic supply); total CO2 charge was measured using a Kessler-Ellis Intellect Integrating Totalizer. Activated molecular sieve zeolite (3A, 1/16 inch beads) was added as required after 2.0 hrs $CO_2$ addition in amounts sufficient to remove the amount of water indicated. (The complete conversion of the $Ca(OH)_2$ charge to $CaCO_3$ will generate 4.18 g of water, requiring the addition of 209 g of zeolite, assuming an equilibrium adsorption capacity of 20 wt %). Removal of more than 70% of the theoretical water required the use of powdered 3A molecular sieves; large amounts of the bead zeolite interfered with solids suspension and mixing (note: solids volume cannot be accurately measured when powdered zeolite is used). The reaction mixture was then allowed to cool to 50° C. while stirring for an additional 30 minutes. The solids content of the crude reaction mixture (not including the zeolite) was determined after centrifugation at 700 g for 10 minutes. Filtration rates determined by measuring the total time for 200 cc of the crude product plus 50 cc of heptane wash through a Buchner funnel containing a 7 cc Whatman #4 filtration paper and 10.0 g of diatomaceous earth (½ atmosphere vacuum). Crystallinity was measured by infrared spectroscopy; amorphous calcium carbonate has a broad infrared band absorption centered at ca. 865 $cm^{-1}$; crystalline calcium carbonate (vaterite or calcite) has a sharp infrared absorption centered at ca. 879 $cm^{-1}$. A comparison of overbased sulfonates with various amounts of water removed by 3A zeolite is shown below in Table II.

TABLE II

Overbased Calcium Sulfonate Comparisons: The Percent Water Removed is Critical

| | RUN | | | | |
|---|---|---|---|---|---|
| | A | B* | C | D | E* |
| Wt. percent CO2 of stoichiometric | 105 | 104 | 104 | 104 | 104 |
| Percent water removed (3A zeolite) | 0 | 36 | 48 | 67 | 100 |
| Product Crystallinity | amor. | amor. | amor. | amor. | amor. |
| Sulfonate utilization (%) | 57 | 74 | 90 | 92 | 84 |
| Solids volume (%) | 32.7 | — | 18.8 | 17.4 | — |
| Total Base Number (TBN) | 325 | 346 | 438 | 430 | 447 |
| Kin Vis 100 C (cSt.) | — | 34 | 135 | 101 | 103 |
| Carbonate/ Sulfonate Ratio (IR) | .880 | .935 | 1.14 | 1.16 | 1.09 |
| Filtration time (seconds) | >10,000 | 758 | 888 | 780 | 308 |

(*)Runs B and E used powdered 3A zeolite. Powdered zeolite is necessary at high zeolite charge amounts to ensure adequate solids mixing.

The data in Table II demonstrates that a certain critical amount of water must be removed to prevent the phenomena associated with overcarbonation. For example, in Runs A and B, overcarbonation occurred; the final product had a low TBN, poor sulfonate utilization, high solids volume and poor filtration. Removal of at least 36% of the total water is required. No dramatic additional improvements are noted if greater than 50% of the water is removed (Runs D and E).

EXAMPLE 3

(This example demonstrates that the critical parameter preventing carbonate crystallization is not simply the total amount of water present in the crude reaction mixture at the end of run, but rather the manner in which water is removed. In other words, crystallization cannot be eliminated by substituting calcium oxide for calcium hydroxide to reduce the total amount of water generated).

Calcium sulfonate (224 g containing 44 wt % active material) was diluted with heptane (637 g) and methanol (55.3 g) in a 2 liter Morton-type glass reaction vessel. A 100–500 SUS (@ 40° C.) diluent oil (70 g) was added at this point, although the oil could also be added to the final product before solvent stripping. Either 100% calcium hydroxide (171.7 g) or a mixture of calcium hydroxide (56.68 g) and calcium oxide (87.08 g) was added to the diluted mixture. A small amount of calcium chloride (0.50 g) was added as a slaking catalyst to the calcium hydroxide/oxide mixture. The calcium oxide/hydroxide mixture proportions were sufficient to reduce the total water content by 67% compared to the 100% calcium hydroxide run (w/ no zeolite addition). The mixture of calcium base, sulfonate and solvents was stirred at 655 RPM (5.72 ft/sec tip speed) using a 2 inch diameter flat blade disk turbine. Precise and reproducible mixing speeds were obtained using a G. K. Heller Series H motor controller. The mixture was heated to 50° C. for 30 minutes, then heated to 60° C. and gaseous carbon dioxide was introduced at a rate of 280 cc/minute for a time sufficient to charge the amount shown in Table III. Activated molecular sieve zeolite (140 g, 3A, 1/16 inch beads) was added as required after 2.0 hrs $CO_2$ addition. This amount is sufficient to remove 67% of the water present at the end of run. The $CO_2$ flow rate was controlled by a Brooks model 5850 E mass flow controller (with a Brooks model 5896 power/electronic supply); total $CO_2$ charge was measured using a Kessler-Ellis Intellect Integrating Totalizer. The reaction mixture was then allowed to cool to 50° C. while stirring for an additional 30 minutes. The solids content of the crude reaction mixture (not including the zeolite) was determined after centrifugation at 700 g for 10 minutes. Filtration rates determined by measuring the total time for 200 cc of the crude product plus 50 cc of heptane wash through a Buchner funnel containing a 7 cc Whatman #4 filtration paper and 10.0 g of diatomaceous earth (½ atmosphere vacuum). Crystallinity was measured by infrared spectroscopy; amorphous calcium carbonate has a broad infrared band absorption centered at ca. 865 $cm^{-1}$; crystalline calcium carbonate (vaterite or calcite) has a sharp infrared absorption centered at ca. 879 $cm^{-1}$. A comparison of three processes, no water removal, water removal by zeolite addition, and water reduction via substitution of CaO base is provided below in Table III.

TABLE III

Overbased Calcium Sulfonate Comparisons: Method of Water Removal more Important than the Amount of Water Present at the End of Run

| | RUN | | |
|---|---|---|---|
| | A | B | C |
| Wt. percent CO2 of stoichiometric | 105 | 104 | 104 |
| Percent water removed (3A zeolite) | 0 | 67 | — |
| Percent water reduction (CaO addn) | — | — | 67 |
| Product Crystallinity | amor. | amor. | cry. |
| Sulfonate utilization (%) | 57 | 92 | 93 |
| Solids volume (%) | 32.7 | 17.4 | 9.6 |
| Total Base Number (TBN) | 325 | 430 | 449 |
| Kin Vis 100 C (cSt.) | — | 101 | 41 |
| Carbonate/Sulfonate Ratio (IR) | .880 | 1.16 | cry. |
| Filtration time (seconds) | >10,000 | 780 | 97 |

The present invention, (illustrated by Run B above); where 67% of the total water was removed by zeolite addition, demonstrated marked improvement over a similar run where no water was removed (Run A) or where the total water content was reduced 67% by the substitution of CaO for 67% of the $Ca(OH)_2$ (Run C). The substitution of CaO for 67% of the $Ca(OH)_2$ (Run C) did result in improvements in sulfonate utilization, solids volume TBN and filtration times, however, the resulting product was extremely hazy due to complete crystallization of all calcium carbonate to vaterite (a particular crystalline structure of calcium carbonate), and was therefore unacceptable as a lubricant additive. The subject invention prevented any carbonate crystallization from occurring.

EXAMPLE 4

(This example demonstrates that the zeolite itself does not adsorb any significant amount of $CO_2$ under the reaction conditions employed).

Calcium sulfonate (224 g containing 44 wt % active material) was diluted with heptane (637 g) and methanol (55.3 g) in a 2 liter Morton-type glass reaction vessel. A 100–500 SUS (@ 40° C.) diluent oil (70 g) was added, but no calcium base was added to this run. The mixture was stirred at 655 RPM (5.72 ft/sec tip speed) using a 2 inch diameter flat blade disk turbine, and heated to 60° C. Precise and reproducible mixing speeds were obtained using a G. K. Heller Series H motor controller. Gaseous carbon dioxide was charged to the mixture at 100 cc/min until saturation ($CO_2$ losses equaled 100 cc/min). The $CO_2$ flow rate was controlled by a Brooks model 5850 E mass flow controller (with a Brooks model 5896 power/electronic supply); total $CO_2$ charge was measured using a Kessler-Ellis Intellect Integrating Totalizer. Activated molecular sieve zeolite (140g, 3A, 1/16 inch beads) was then charged to the mixture, and $CO_2$ was again added at 100 cc/min until $CO_2$ losses equaled 100 cc/min. Less than 400 cc of $CO_2$ was adsorbed by the zeolite as measured by this method.

This experiment demonstrates that the 3A zeolite, by itself, is incapable of adsorbing any significant amount of $CO_2$. For example, an extra 5% $CO_2$ charge to a run as described in Example 1, would require 2600 cc of $CO_2$. Even less $CO_2$ is expected to be adsorbed by the zeolite when water is present

EXAMPLE 5

(This example demonstrates that the subject invention avoids processing problems associated with "precrystallization" phenomenon, particularly poor filtration rates, low sulfonate utilization, and partial crystallization of the carbonate base).

Calcium sulfonate (224 g containing 44 wt % active material) was diluted with heptane (637 g) and methanol (55.3 g) in a 2 liter Morton-type glass reaction vessel. A 100–500 SUS (@ 40° C.) diluent oil (70 g) was added at this point, although the oil could also be added to the final product before solvent stripping. Calcium hydroxide (171.7 g) was added to the diluted mixture, which was then stirred at 655 RPM (5.72 ft/sec tip speed) using a 2 inch diameter flat blade disk turbine. Precise and reproducible mixing speeds were obtained using a G. K. Heller Series H motor controller. The mixture was heated to 50° C. for 30 minutes, then heated to 60° C. and gaseous carbon dioxide was introduced at a rate of 280 cc/minute for a time sufficient to charge the amount shown in Table V. (A $CO_2$ charge sufficient to react with 100% of the calcium hydroxide requires 2.321 moles or 52,023 cc of $CO_2$.) Activated molecular sieve zeolite (140g, 3A, 1/16 inch beads) was added after 2.0 hrs $CO_2$ addition (corresponding to 65% of the theoretical maximum $CO_2$ charge). The complete conversion of the $Ca(OH)_2$ charge to $CaCO_2$ will generate 41.8 g of water, requiring the addition of 209 g of zeolite (assuming an equilibrium adsorption capacity of 20 wt %); 140g of zeolite is sufficient to remove 67% of the total water generated. The $CO_2$ flow rate was controlled by a Brooks model 5850 E mass flow controller (with a Brooks model 5896 power/electronic supply); total $CO_2$ charge was measured using a Kessler-Ellis Intellect Integrating Totalizer. After complete $CO_2$ addition, the reaction mixture was allowed to cool to 50° C. and was stirred for an additional 30 minutes. The solids content of the crude reaction mixture was determined after centrifugation at 700 g for 10 minutes. Filtration rates were determined by measuring the total time for 200 cc of the crude product plus 50 cc of heptane wash through a Buchner funnel containing a 7 cc Whatman #4 filtration paper and 10.0 g of diatomaceous earth (½ atmosphere vacuum). Crystallinity was measured by infrared spectroscopy; amorphous calcium carbonate has a broad infrared band absorption centered at ca. 865 $cm^{-1}$; crystalline calcium carbonate (vaterite or calcite) has a sharp infrared absorption centered at ca. 879 $cm^{-1}$. A comparison of overbased sulfonates demonstrating detrimental precrystallization effects on both processing and final product characteristics is provided below in Table IV.

TABLE IV

Overbased Calcium Sulfonate Comparisons: Detrimental Precrystallization Effects on Processing and Product Quality

| | RUN | | | | |
|---|---|---|---|---|---|
| | A | B | C | D | E |
| Wt. percent CO2 of stoichiometric | 78 | 95 | 100 | 105 | 104 |
| Percent water removed (3A zeolite) | 0 | 0 | 0 | 0 | 67 |
| Product Crystallinity | amor. | amor. | amor. | amor. | amor. |

TABLE IV-continued

Overbased Calcium Sulfonate Comparisons: Detrimental Precrystallization Effects on Processing and Product Quality

| | RUN | | | | |
|---|---|---|---|---|---|
| | A | B | C | D | E |
| Sulfonate utilization (%) | 78 | 89 | 85 | 57 | 92 |
| Solids volume (%) | 22.4 | 21.8 | 22.9 | 32.7 | 17.4 |
| Total Base Number (TBN) | 402 | 424 | 413 | 325 | 430 |
| Kin Vis 100 C (cSt.) | — | 108 | 190 | — | 101 |
| Carbonate/ Sulfonate Ratio (IR) | .996 | .955 | .911 | .880 | 1.16 |
| Filtration time (seconds) | 304 | 855 | 862 | >10,000 | 780 |

Processing difficulties are encountered as the $CO_2$ charge approaches or exceeds 100% for a typical sulfonate overbasing process (Runs A-D). Filtration time increase rapidly, and TBN values and % sulfonate utilization decrease. These undesirable effects occur at much lower $CO_2$ charge ratios in actual plant operation, and limit the effective maximum $CO_2$ charge to no more than 85% of theoretical. In contrast, no such limitation is observed for the subject invention (Run E), detrimental "precrystallization effects" have been eliminated.

EXAMPLE 6

(This example demonstrates that the precise time when water is removed from the system is not critical. In the examples shown below, the zeolite is added at a $CO_2$ charge between 48% and 81% of theoretical with essentially no change in product quality. However, the zeolite cannot be added too close to the end of the run or the risk of overcarbonation becomes too great. The zeolite can be added at the beginning of the run, however, this is not preferred and may lead to slightly poorer processing).

Calcium sulfonate (224 g containing 44 wt % active material) was diluted with heptane (637 g) and methanol (55.3 g) in a 2 liter Morton-type glass reaction vessel. A 100–500 SUS (@ 40° C.) diluent oil (70 g) was added at this point, although the oil could also be added to the final product before solvent stripping. Calcium hydroxide (171.7 g) was added to the diluted mixture, which was then stirred at 655 RPMY (5.72 ft/sec tip speed) using a 2 inch diameter flat blade disk turbine. Precise and reproducible mixing speeds were obtained using a G. K. Heller Series H motor controller. The mixture was heated to 50° C. for 30 minutes, then heated to 60° C. and gaseous carbon dioxide was introduced at a rate of 280 cc/minute for a time sufficient to charge the amount shown in Table V. (A $CO_2$ charge sufficient to react with 100% of the calcium hydroxide requires 2.321 moles or 52,023 cc of $CO_2$ at STP.) Activated molecular sieve zeolite (140g, 3A, 1/16 inch beads) was added after 2.0 hrs $CO_2$ addition (corresponding to 65% of the theoretical maximum $CO_2$ charge). The complete conversion of the $Ca(OH)_2$ charge to $CaCO_2$ will generate 41.8 g of water, requiring the addition of 209 g of zeolite (assuming an equilibrium adsorption capacity of 20 wt %); 140 g of zeolite is sufficient to remove 67% of the total water generated. The $CO_2$ flow rate was controlled by a Brooks model 5850 E mass flow controller (with a Brooks model 5896 power/electronic supply); total $CO_2$ charge was measured using a Kessler-Ellis Intellect Integrating Totalizer. After complete $CO_2$ addition, the reaction mixture was allowed to cool to 50° C. and was stirred for an additional 30 minutes. The solids content of the crude reaction mixture was determined after centrifugation at 700 g for 10 minutes. Filtration rates were determined by measuring the total time for 200 cc of the crude product plus 50 cc of heptane wash through a Buchner funnel containing a 7 cc Whatman #4 filtration paper and 10.0 g of diatomaceous earth (½ atmosphere vacuum). Crystallinity was measured by infrared spectroscopy; amorphous calcium carbonate has a broad infrared band absorption centered at ca. 865 $cm^{-1}$; crystalline calcium carbonate (vaterite or calcite) has a sharp infrared absorption centered at ca. 879 $cm^{-1}$. The data provided in Table V, below, demonstrates that the time of zeolite additive is not critical, and can be varied over a certain range with no detrimental effects.

TABLE V

Overbased Calcium Sulfonate Comparisons: Time of Zeolite Addition can be Varied

| | RUN | | |
|---|---|---|---|
| | A | B | C |
| Percent CO2 Charged (of stoichiometric) | 104 | 104 | 104 |
| Percent water removed (3A zeolite) | 48 | 48 | 48 |
| Time of Zeolite Addn. (hrs CO2 charge) | 1.5 | 2.0 | 2.5 |
| Percent CO2 Charged @ Zeolite Addn. | 48 | 65 | 81 |
| Product Crystallinity | amor. | amor. | amor. |
| Total Base Number (TBN) | 443 | 438 | 428 |
| Product viscosity | fluid | fluid | fluid |
| Carbonate/Sulfonate Ratio (IR) | 1.07 | 1.14 | 1.15 |

The above results also suggests that the zeolite could be incorporated into a drying column rather than added batchwise, since the time of water removal is not a critical factor. (Water removal using a fixed bed of drying agent would be slower than batchwise addition because of the time required for the vapor phase to make contact with the drying agent.)

EXAMPLE 7

(This example demonstrates that a 4A zeolite can be used in place of the 3A zeolite. The 4A zeolite is capable of removing methanol and $CO_2$ from the system, but since water is adsorbed much more strongly, it will be the predominant material removed. Zeolite effectiveness in preventing crystallization may be expected to drop off rapidly for zeolite with larger pore diameters (5A, 13X etc.), since these zeolite will not only remove more methanol than 4A zeolite, but are also capable of removing $CO_2$). Calcium sulfonate (224 g containing 44 wt % active material) was diluted with heptane (637 g) and methanol (55.3 g) in a 2 liter Morton-type glass reaction vessel. A 100–500 SUS (@ 40° C.) diluent oil (70 g) was added at this point, although the oil could also be added to the final product before solvent stripping. Calcium hydroxide (171.7 g) was added to the diluted mixture, which was then stirred at 655 RPM (5.72 ft/sec tip speed) using a 2 inch diameter flat blade disk turbine. Precise and reproducible mixing speeds were obtained using a G. K. Heller Series H motor controller. The mixture was heated to 50° C. for 30 minutes, then heated to 60° C. and gaseous carbon dioxide was introduced at a rate of 280 cc/minute for a time sufficient to charge the amount shown in Table VI. (A $CO_2$ charge sufficient to react with 100% of the calcium hydroxide requires 2.321 moles or 52,023 cc of $CO_2$.) Activated molecular sieve zeolite (140g, 3A, 1/16 inch beads or 140 g 4A, 1/16 inch beads) was added after 2.0 hrs $CO_2$ addition (corresponding to 65% of the theoretical maximum $CO_2$ charge). The complete conversion of the $Ca(OH)_2$ charge to $CaCO_3$ will generate 41.8 g of water, requiring the addition of 209 g of zeolite (assuming an equilibrium adsorption capacity of 20 wt %); 140g of zeolite is sufficient to remove 67% of the total water generated. The $CO_2$ flow rate was controlled by a Brooks model 5850 E mass flow controller (with a Brooks model 5896 power/electronic supply); total $CO_2$ charge was measured using a Kessler-Ellis Intellect Integrating Totalizer. After complete $CO_2$ addition, the reaction mixture was allowed to cool to 50° C. and was stirred for an additional 30 minutes. The solids content of the crude reaction mixture was determined after centrifugation at 700 g for 10 minutes. Filtration rates were determined by measuring the total time for 200 cc of the crude product plus 50 cc heptane wash through a Buchner funnel containing a 7 cc Whatman #4 filtration paper and 10.0 g of diatomaceous earth (½ atmosphere vacuum). Crystallinity was measured by infrared spectroscopy; amorphous calcium carbonate has a broad infrared band absorption centered at ca. 865 $cm^{-1}$; crystalline calcium carbonate (vaterite or calcite) has a sharp infrared absorption centered at ca. 879 $cm^{-1}$. The effects of zeolite 3A and 4A are compared, below, in Table VI.

TABLE VI

Overbased Calcium Sulfonate Comparisons: Both 4A and 3A Zeolites are Effective in Preventing Crystallization

| | RUN | |
|---|---|---|
| | A | B |
| Wt. percent CO2 of stoichiometric | 104 | 104 |
| Percent water removed (3A zeolite) | 67 | — |
| Percent water removed (4A zeolite) (*) | — | 67 |
| Product Crystallinity | amor. | amor. |
| Sulfonate utilization (%) | 92 | 90 |
| Solids volume (%) (zeolite excl.) | 17.4 | 18.4 |
| Total Base Number (TBN) | 430 | 434 |
| Kin Vis 100 C (cSt.) | 101 | 119 |
| Carbonate/Sulfonate Ratio (IR) | 1.16 | 1.08 |
| Filtration time (seconds) | 780 | 1085 |

(*)assuming no methanol adsorption for comparison purposes

The data shown in Table VI demonstrates that both the 3A and 4A zeolites are equally effective in removing water in this reaction system and preventing overcarbonation.

In view of the results of the above Examples, it is clear that the present invention is an improved process for preparing overbased alkaline earth sulfonates which offers numerous advantages over the present art, including the following key advantages:

1. The invention prevents crystallization of the alkaline earth carbonate at high $CO_2$ charge amounts. Carbon dioxide may be charged in amounts exceeding 100% of the theoretical amount required to react with the base charge without encountering processing difficulties and maintaining high product quality.
2. Overbased sulfonate products produced using the present invention have higher TBN values, higher feedstock utilization (sulfonate and lime), and reduced solids waste when compared to older conventional processes.
3. The resulting products have superior stability and resistance to the formation of crystalline carbonate.

We claim:

1. A method of preparing an amorphous overbased calcium sulfonate detergent for lubricants, said method comprising;

(a) mixing a solution of a calcium sulfonate in a volatile hydrocarbon solvent with $CH_3OH$ and $Ca(OH)_2$ solids;

(b) stirring and heating said sulfonate mixture;

(c) adding to said stirred sulfonate mixture a sufficient amount of $CO_2$ to react with up to 80% of the $Ca(OH)_2$;

(d) adding an activates solid adsorbent to said $CO_2$ treated mixture to remove at least 35% of the water generated in the entire carbonation reaction;

(e) continuing addition of $CO_2$ until the total amount of $CO_2$ added exceeds 90–105% of the amount required to react with the $Ca(OH)_2$ solids;

(f) filtering said adsorbent-treated sulfonate mixture to separate the adsorbent and any unreacted $Ca(OH)_2$ solids from an amorphous calcium sulfonate product;

(g) stripping said sulfonate product of said volatile hydrocarbon solvent; and (h) recovering the amorphous overbased calcium sulfonate product.

2. The method of claim 1 wherein the calcium sulfonate has a total base number of about 300 to about 500 TBN.

3. The method of claim 1 wherein said activated adsorbent is selected from the group consisting of alumina, silica gel, 3A zeolite and 4A zeolite.

4. The method of claim 3 wherein the adsorbent is 3A zeolite.

5. The method of claim 3 wherein the adsorbent is 4A zeolite.

6. The method of claim 1 wherein said sulfonate mixture is stirred at a rate sufficient to maintain the solids in suspension at a temperature of about 45° C. to about 60° C.

* * * * *